US009322149B2

(12) United States Patent
Takaura et al.

(10) Patent No.: US 9,322,149 B2
(45) Date of Patent: Apr. 26, 2016

(54) WORK VEHICLE

(71) Applicant: KOMATSU LTD., Tokyo (JP)

(72) Inventors: Takeshi Takaura, Minoh (JP); Yoshiki Kami, Hadano (JP); Jin Kitajima, Ohiso-machi (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 14/372,475

(22) PCT Filed: Apr. 24, 2014

(86) PCT No.: PCT/JP2014/061539

§ 371 (c)(1),
(2) Date: Jul. 16, 2014

(87) PCT Pub. No.: WO2014/192475

PCT Pub. Date: Dec. 4, 2014

(65) Prior Publication Data

US 2015/0308082 A1 Oct. 29, 2015

(51) Int. Cl.

| | |
|---|---|
| ***G06F 7/70*** | (2006.01) |
| ***E02F 9/26*** | (2006.01) |
| ***E02F 9/20*** | (2006.01) |
| ***E02F 3/32*** | (2006.01) |
| ***E02F 3/43*** | (2006.01) |

(52) U.S. Cl.

CPC . *E02F 9/262* (2013.01); *E02F 3/32* (2013.01); *E02F 3/43* (2013.01); *E02F 3/439* (2013.01); *E02F 9/20* (2013.01); *E02F 9/2029* (2013.01); *E02F 9/2033* (2013.01); *E02F 9/265* (2013.01)

(58) Field of Classification Search

CPC ..... E02F 9/26; E02F 9/265

See application file for complete search history.

(56) References Cited

U.S. PATENT DOCUMENTS

2014/0214240 A1* 7/2014 Funke ..... G07C 3/00 701/2

FOREIGN PATENT DOCUMENTS

| | | | |
|---|---|---|---|
| JP | 2001-032331 | A | 2/2001 |
| JP | 2001-227001 | A | 8/2001 |
| JP | 2008-216143 | A | 9/2008 |
| JP | 2013-217137 | A | 10/2013 |

* cited by examiner

*Primary Examiner* — Michael D Lang

(74) *Attorney, Agent, or Firm* — Drinker Biddle & Reath LLP

(57) ABSTRACT

There is provided a work vehicle in which a work implement can be freely operated. The work vehicle includes: a design surface information acquiring unit for acquiring data of a design surface indicative of a target shape of a work object by the work implement; a cutting edge position computing unit for computing a position of a cutting edge of a bucket; and an operation restricting unit for executing operation restriction control by which, when the cutting edge of the bucket comes closer to the design surface, operation of the work implement is stopped before the cutting edge of the bucket reaches the design surface. In a case where the cutting edge is located away from the design surface in a downward perpendicular direction by a prescribed distance or longer, the operation restricting unit does not execute the operation restriction control.

5 Claims, 8 Drawing Sheets

WORK VEHICLE

TECHNICAL FIELD

The present invention relates to a work vehicle.

BACKGROUND ART

In conventional work vehicles, there is a technique of restricting an operating range of a front work device to a prescribed area provided in advance. For example, PTD 1 discloses a control device for restricting an operating range of a front work device to a prescribed area, wherein the operation restriction on the front work device is lifted when the operation of at least one of an undercarriage and an upper revolving unit is detected.

CITATION LIST

Patent Document

PTD 1: Japanese Patent Laying-Open No. 2001-32331

SUMMARY OF INVENTION

Technical Problem

A work vehicle that acquires design surface information from the outside, detects a position of a work implement and automatically controls the work implement based on the detected position of the work implement is also being developed.

In the case of aligning a cutting edge of a bucket with a design surface in a hydraulic excavator as a work vehicle, control for automatically stopping the operation of the work implement at a position where the cutting edge comes into contact with the design surface is executed in order to avoid the cutting edge of the bucket from cutting into the design surface.

In an embankment work when developing a land or a road, an upper surface of an embankment serves as a design surface in an area that will be subjected to the embankment work (area scheduled for embankment). Therefore, if the aforementioned control is effective during the embankment work, the work implement stops automatically when the bucket enters an area lower than the design surface before embankment. Thus, the operator cannot perform the operation for lowering a boom.

An object of the present invention is to provide a technique by which a work implement can be freely operated in the state where a cutting edge of a bucket is located lower than a design surface in the perpendicular direction.

Solution to Problem

A work vehicle according to the present invention includes: a work implement; a design surface information acquiring unit; a cutting edge position computing unit; and an operation restricting unit. The work implement has a boom, an arm attached to a distal end of the boom, and a bucket attached to a distal end of the arm. The design surface information acquiring unit acquires data of a design surface indicative of a target shape of a work object by the work implement. The cutting edge position computing unit computes a position of a cutting edge of the bucket. The operation restricting unit executes operation restriction control. The operation restriction control is control by which, when the cutting edge of the bucket comes closer to the design surface, operation of the work implement is stopped before the cutting edge of the bucket reaches the design surface. In a case where the cutting edge is located away from the design surface in a downward perpendicular direction by a prescribed distance or longer, the operation restricting unit does not execute the operation restriction control.

According to the work vehicle of the present invention, the work implement can be freely operated in the state where the cutting edge is located at a position equal to or lower than the design surface in the perpendicular direction.

In the work vehicle, the operation restricting unit controls the boom to prevent the position of the cutting edge from becoming lower than the design surface. Thus, invasion of the design surface by the work implement can be prevented, and therefore, the quality and efficiency of the land leveling work with the hydraulic excavator can be enhanced.

The work vehicle transmits and receives information to and from the outside by satellite communication. Thus, the construction based on the information transmitted and received to and from the outside becomes possible, and the highly-efficient and highly-accurate land leveling work with the work vehicle can be realized.

Advantageous Effects of Invention

As described above, according to the present invention, the work implement can be freely operated in the state where the cutting edge of the bucket is located lower than the design surface in the perpendicular direction.

DESCRIPTION OF EMBODIMENTS

An embodiment of the present invention will be described hereinafter with reference to the drawings.

First, a configuration of a hydraulic excavator as one example of a work vehicle to which a technical idea of the present invention is applicable will be described.

Figure 1:
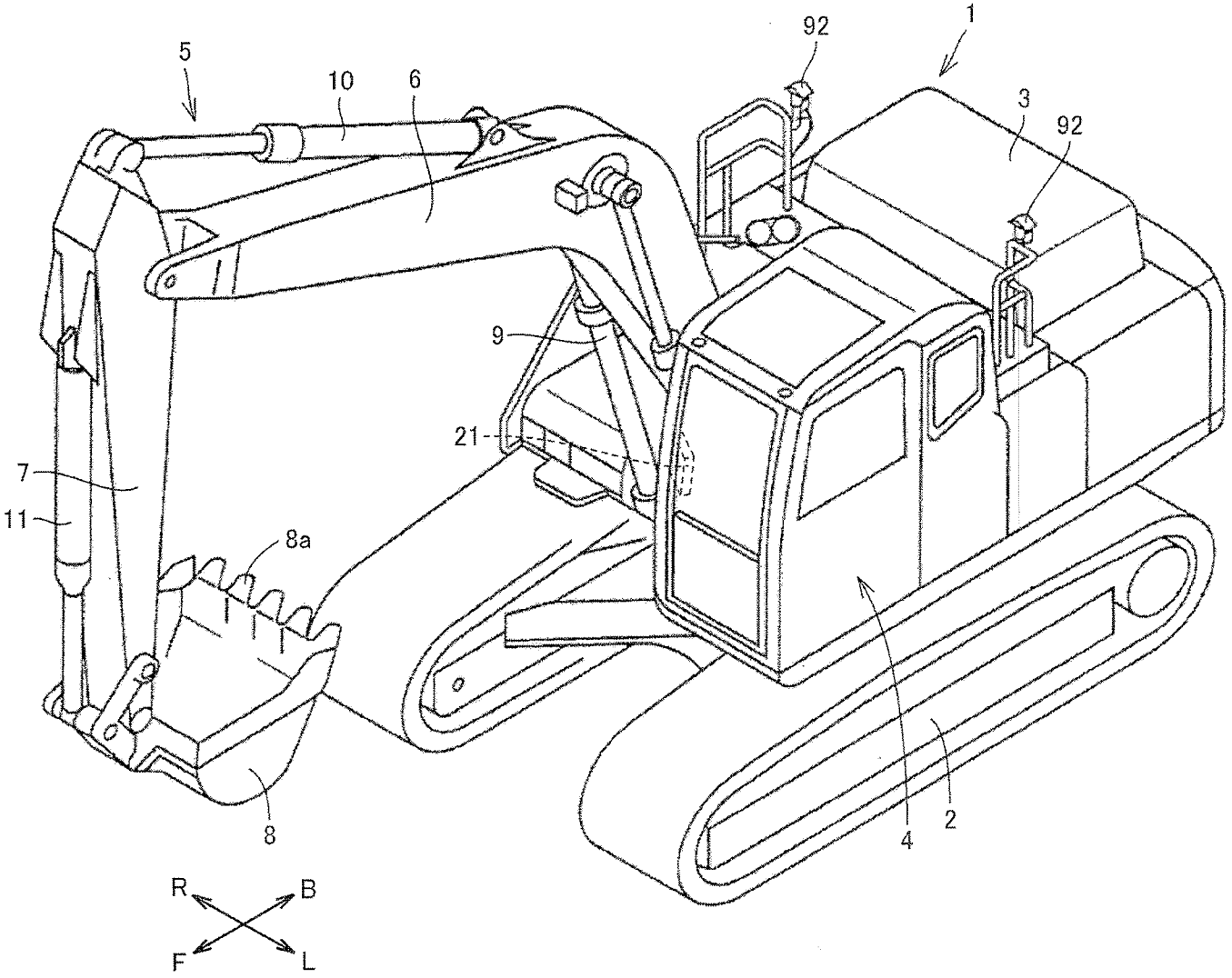
FIG. 1 is a schematic perspective view showing a configuration of a hydraulic excavator according to one embodiment of the present invention.

FIG. 1 is a schematic perspective view showing a configuration of a hydraulic excavator 1 according to one embodiment of the present invention. As shown in FIG. 1, hydraulic excavator 1 mainly includes an undercarriage 2, an upper revolving unit 3 and a work implement 5. Undercarriage 2 and upper revolving unit 3 constitute a work vehicle main body.

Undercarriage 2 has a pair of left and right crawler belts. It is configured to allow hydraulic excavator 1 to be self-propelled by rotation of the pair of crawler belts. Upper revolving unit 3 is disposed to be pivotable with respect to undercarriage 2.

Upper revolving unit 3 includes a cab 4 that is a space for an operator to operate hydraulic excavator 1. Cab 4 is included in the work vehicle main body. On the backward side B, upper revolving unit 3 includes an engine compartment that houses an engine, and a counter weight. In the present embodiment, the frontward side (front side) of the operator when seated in cab 4 will be referred to as frontward side F of upper revolving unit 3, and the side opposite to frontward side F, i.e., the backward side of the operator will be referred to as backward side B of upper revolving unit 3. The left side of the operator when seated will be referred to as left side L of upper revolving unit 3, and the right side of the operator when seated will be referred to as right side R of upper revolving unit 3. In the following description, it is assumed that the frontward-backward and left-right directions of upper revolving unit 3 match the frontward-backward and left-right directions of hydraulic excavator 1.

Work implement 5 that performs works such as soil excavation is pivotably supported by upper revolving unit 3 so as to be operable in the upward-downward direction. Work implement 5 has a boom 6 attached to a substantially central portion on frontward side F of upper revolving unit 3 so as to be operable in the upward-downward direction, an arm 7 attached to a distal end of boom 6 so as to be operable in the backward-frontward direction, and a bucket 8 attached to a distal end of arm 7 so as to be operable in the backward-frontward direction. Bucket 8 has a cutting edge 8*a* at a tip thereof. Boom 6, arm 7 and bucket 8 are configured to be driven by a boom cylinder 9, an arm cylinder 10 and a bucket cylinder 11 that are hydraulic cylinders, respectively.

Cab 4 is arranged on frontward side F and on left side L of upper revolving unit 3. With respect to cab 4, work implement 5 is provided on right side R that is one side portion side of cab 4. It should be noted that the arrangement of cab 4 and work implement 5 is not limited to the example shown in FIG. 1, and work implement 5 may be provided, for example, on the left side of cab 4 arranged on the frontward right side of upper revolving unit 3.

Figure 2:
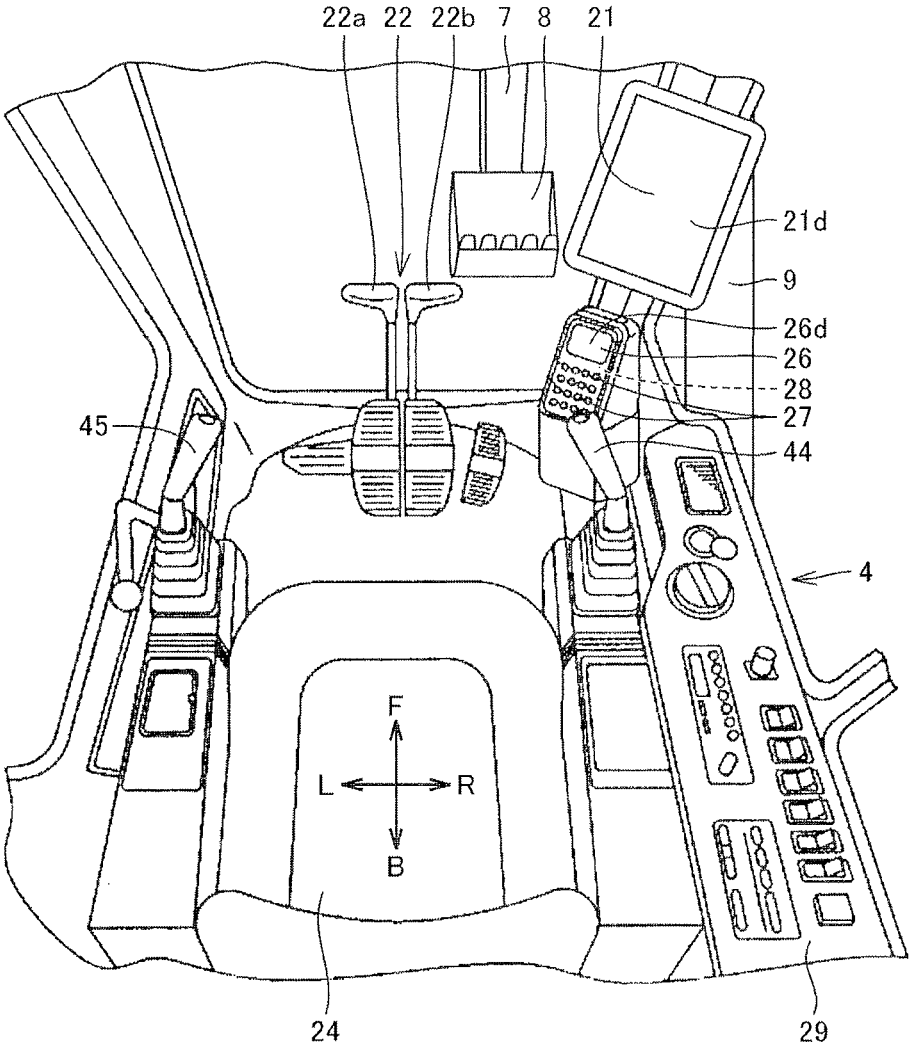
FIG. 2 is a perspective view of the inside of a cab of the hydraulic excavator.

FIG. 2 is a perspective view of the inside of cab 4 of hydraulic excavator 1. As shown in FIG. 2, an operator's seat 24 on which the operator facing toward frontward side F is seated is arranged inside cab 4. Cab 4 includes a roof portion arranged to cover operator's seat 24, and a plurality of pillars supporting the roof portion. The plurality of pillars have a front pillar arranged on frontward side F with respect to operator's seat 24, a rear pillar arranged on backward side B with respect to operator's seat 24, and an intermediate pillar arranged between the front pillar and the rear pillar. Each pillar extends along a perpendicular direction orthogonal to a horizontal surface, and is coupled to a floor portion and the roof portion of cab 4.

A space surrounded by each pillar and the floor and roof portions of cab 4 forms an interior space of cab 4. Operator's seat 24 is housed in the interior space of cab 4 and is arranged at a substantially center of the floor portion of cab 4. A side surface on left side L of cab 4 is provided with a door for the operator to get in or out of cab 4.

A front window is arranged on frontward side F with respect to operator's seat 24. The front window is made of a transparent material and the operator seated on operator's seat 24 can view the outside of cab 4 through the front window. For example, as shown in FIG. 2, the operator seated on operator's seat 24 can directly view bucket 8 excavating soil through the front window.

A monitor device 26 is disposed on frontward side F inside cab 4. Monitor device 26 is arranged at a corner on the frontward right side inside cab 4, and is supported by a support extending from the floor portion of cab 4. Monitor device 26 is arranged on the operator's seat 24 side with respect to the front pillar. Monitor device 26 is arranged in front of the front pillar when viewed from the operator seated on operator's seat 24.

For multipurpose use, monitor device 26 includes a planar display surface 26*d* having various monitor functions, a switch unit 27 having a plurality of switches to which many functions are assigned, and a sound generator 28 that expresses by sound the contents displayed on display surface 26*d*. This display surface 26*d* is configured by a graphic indicator such as a liquid crystal indicator and an organic EL indicator. Although switch unit 27 includes a plurality of key switches, the present invention is not limited thereto. Switch unit 27 may include touch panel-type touch switches.

Travel control levers (left and right travel control levers) 22*a* and 22*b* for the left and right crawler belts are provided on frontward side F of operator's seat 24. Left and right travel control levers 22*a* and 22*b* form a travel control unit 22 for controlling undercarriage 2.

A first control lever 44 for the operator on cab 4 to control driving of boom 6 and bucket 8 of work implement 5 is provided on right side R of operator's seat 24. A switch panel 29 having various switches and the like mounted thereon is also provided on right side R of operator's seat 24. A second control lever 45 for the operator to control driving of arm 7 of work implement 5 and revolving of upper revolving unit 3 is provided on left side L of operator's seat 24.

A monitor 21 is arranged above monitor device 26. Monitor 21 has a planar display surface 21*d*. Monitor 21 is attached to the front pillar on right side R, which is the side close to work implement 5, of the pair of front pillars. Monitor 21 is arranged in front of the front pillar in the line of sight of the operator seated on operator's seat 24 toward the frontward right direction. By attaching monitor 21 to the front pillar on right side R in hydraulic excavator 1 including work implement 5 on right side R of cab 4, the operator can view both work implement 5 and monitor 21 with a small amount of line-of-sight movement.

Figure 3:
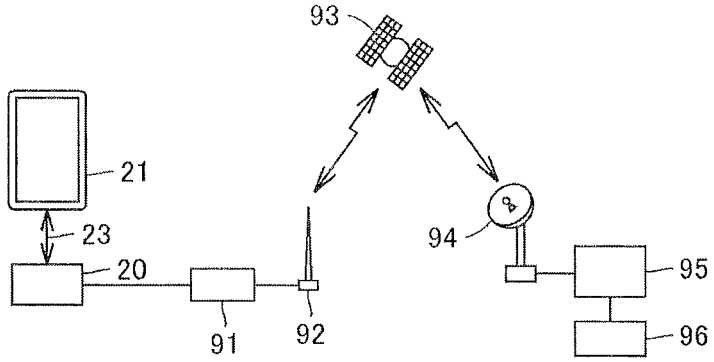
FIG. 3 is a schematic view showing a schematic configuration for transmitting and receiving information to and from the hydraulic excavator.

FIG. 3 is a schematic view showing a schematic configuration for transmitting and receiving information to and from hydraulic excavator 1. Hydraulic excavator 1 includes a controller 20. Controller 20 has a function of controlling operation of work implement 5, revolving of upper revolving unit 3, travel driving of undercarriage 2, and the like. Controller 20 and monitor 21 are connected by a bidirectional network communication cable 23 and form a communication network inside hydraulic excavator 1. Monitor 21 and controller 20 can mutually transmit and receive information via network communication cable 23. Each of monitor 21 and controller 20 is configured mainly by a computer device such as a microcomputer.

Information can be transmitted and received between controller 20 and an external monitoring station 96. In the present embodiment, controller 20 and monitoring station 96 communicate with each other by satellite communication. A communication terminal 91 having a satellite communication antenna 92 is connected to controller 20. As shown in FIG. 1, satellite communication antennas 92 are spaced apart from each other in the left-right direction and mounted on upper revolving unit 3. A network control station 95 linked by a dedicated line to a communication earth station 94 communicating with a communication satellite 93 by a dedicated communication line is connected to monitoring station 96 on the ground via the Internet and the like. As a result, data is transmitted and received between controller 20 and prescribed monitoring station 96 via communication terminal 91, communication satellite 93, communication earth station 94, and network control station 95.

Construction design data created by a three-dimensional CAD (Computer Aided Design) is prestored in controller 20. Monitor 21 updates and displays the externally-received current position of hydraulic excavator 1 on the screen in real time, such that the operator can constantly check the work state of hydraulic excavator 1.

Controller 20 compares the construction design data with the position and posture of work implement 5 in real time, and drives a hydraulic circuit based on the result of comparison, thereby controlling work implement 5. More specifically, controller 20 compares the target shape (design surface) of a work object based on the construction design data with the position of bucket 8, and executes control to prevent cutting edge 8*a* of bucket 8 from being located lower than the design surface to prevent deeper excavation than the design surface. As a result, the construction efficiency and the construction accuracy can be enhanced, and high-quality construction can be easily performed.

Figure 4:
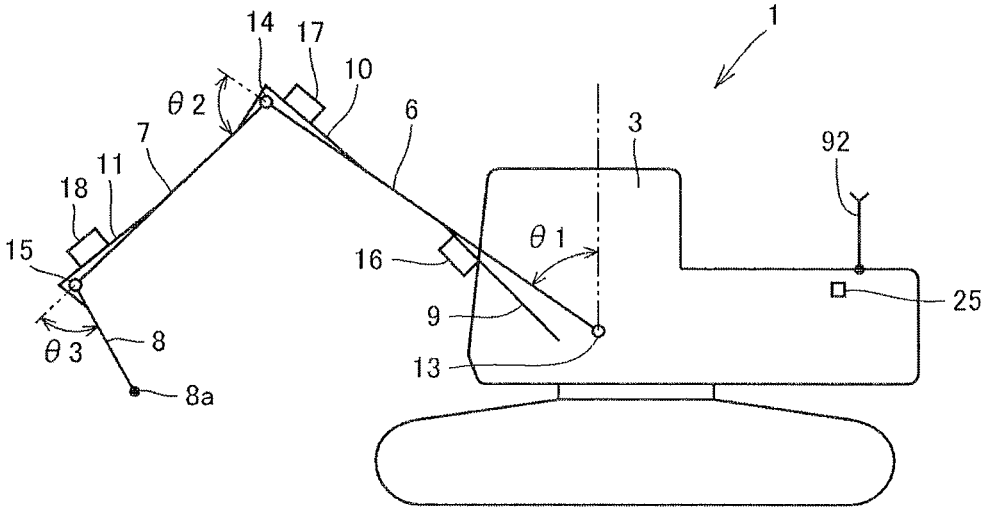
FIG. 4 is a diagram schematically showing the hydraulic excavator when viewed from the side.

FIG. 4 is a diagram schematically showing hydraulic excavator 1 when viewed from the side. As shown in FIG. 4, a proximal end of boom 6 is attached to a front part of upper revolving unit 3 by a boom pin 13. A proximal end of arm 7 is attached to the distal end of boom 6 by an arm pin 14. Bucket 8 is attached to the distal end of arm 7 by a bucket pin 15.

Boom cylinder 9, arm cylinder 10 and bucket cylinder 11 are provided with first to third stroke sensors 16 to 18, respectively. First stroke sensor 16 detects a stroke length of boom cylinder 9. Second stroke sensor 17 detects a stroke length of arm cylinder 10. Third stroke sensor 18 detects a stroke length of bucket cylinder 11. Inclination angles θ1 to θ3 shown in FIG. 4 will be described below.

A global coordinate computing device 25 is provided in upper revolving unit 3. A signal received by satellite communication antenna 92 is inputted to global coordinate computing device 25. Global coordinate computing device 25 computes a position of satellite communication antenna 92.

Figure 5:
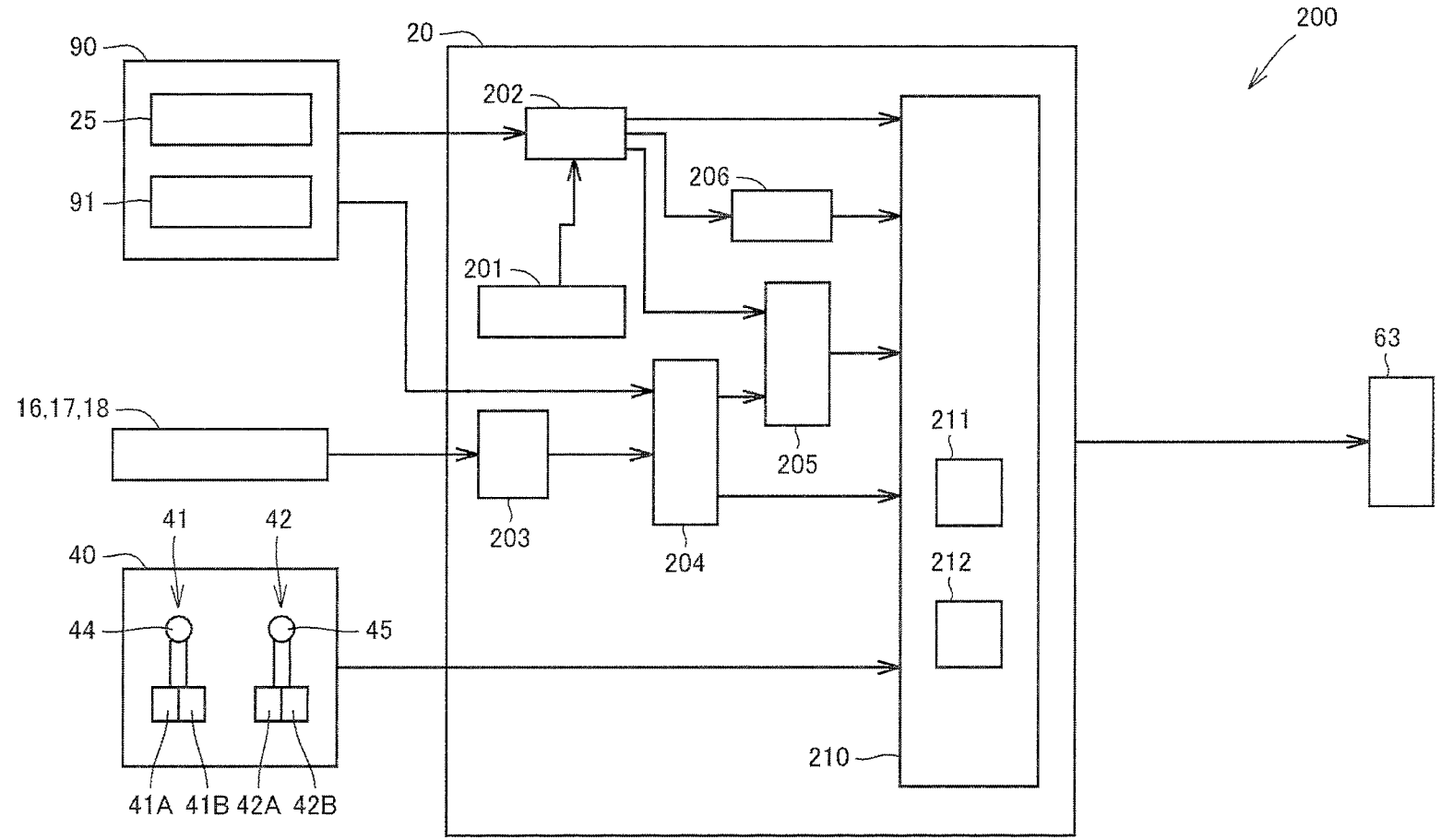
FIG. 5 is a block diagram showing a functional configuration of a control system of the hydraulic excavator.

FIG. 5 is a block diagram showing a functional configuration of a control system 200 of hydraulic excavator 1. As shown in FIG. 5, control system 200 for controlling hydraulic excavator 1 according to the present embodiment includes an operating device 40, controller 20 and an input unit 90. Input unit 90 has aforementioned global coordinate computing device 25 and communication terminal 91.

Operating device 40 accepts the operator's operation for driving work implement 5, and outputs an operation signal corresponding to the operator's operation. Operating device 40 has a first control lever device 41 and a second control lever device 42. First control lever device 41 has a first control lever 44 operated by the operator, a boom operation detecting unit 41A and a bucket operation detecting unit 41B. Second control lever device 42 has a second control lever 45 operated by the operator, a revolving operation detecting unit 42A and an arm operation detecting unit 42B.

First control lever 44 accepts the operator's operation of boom 6 and the operator's operation of bucket 8. Boom operation detecting unit 41A outputs a boom operation signal in accordance with the operation of first control lever 44. Bucket operation detecting unit 41B outputs a bucket operation signal in accordance with the operation of first control lever 44.

Second control lever 45 accepts the operator's operation for revolving upper revolving unit 3 and the operator's operation of arm 7. Revolving operation detecting unit 42A outputs a revolving operation signal in accordance with the operation of second control lever 45. Arm operation detecting unit 42B outputs an arm operation signal in accordance with the operation of second control lever 45.

Controller 20 has a storage unit 201, a design surface information acquiring unit 202, a work implement angle computing unit 203, a cutting edge position computing unit 204, a distance calculating unit 205, a design surface angle calculating unit 206, and a computing unit 210.

Storage unit 201 has various information, programs, threshold values, maps and the like stored therein. Controller 20 reads data from storage unit 201 or stores data in storage unit 201 when necessary.

Design surface information acquiring unit 202 acquires data of a design surface indicative of a three-dimensional target object of a work object by work implement 5. In the case where the data of the design surface is inputted in advance to storage unit 201 and storage unit 201 has the data of the design surface stored therein, design surface information acquiring unit 202 reads the data of the design surface from storage unit 201. Alternatively, via communication terminal 91, design surface information acquiring unit 202 may acquire, from the outside, the data of the design surface updated as needed.

Work implement angle computing unit 203 acquires data about the boom cylinder length, the arm cylinder length and the bucket cylinder length from first to third stroke sensors 16 to 18. Work implement angle computing unit 203 also calculates inclination angle θ1 of boom 6 with respect to the vertical direction in a coordinate system of the work vehicle main body, based on the boom cylinder length detected by first stroke sensor 16. Work implement angle computing unit 203 also calculates inclination angle θ2 of arm 7 with respect to boom 6, based on the arm cylinder length detected by second stroke sensor 17. Work implement angle computing unit 203 also calculates inclination angle θ3 of cutting edge 8*a* of bucket 8 with respect to arm 7, based on the bucket cylinder length detected by third stroke sensor 18.

Cutting edge position computing unit 204 acquires inclination angles θ1 to θ3 from work implement angle computing unit 203, and computes a relative position of cutting edge 8*a* of bucket 8 with respect to the work vehicle main body. Cutting edge position computing unit 204 also acquires the position of satellite communication antenna 92 from global coordinate computing device 25. Based on the position of satellite communication antenna 92 and the relative position of cutting edge 8*a* of bucket 8 with respect to the work vehicle main body, cutting edge position computing unit 204 calculates the current position of cutting edge 8*a*.

Distance calculating unit 205 acquires the current position of cutting edge 8*a* of bucket 8 from cutting edge position computing unit 204, and acquires the data of the design surface from design surface information acquiring unit 202. Distance calculating unit 205 computes a relative position of cutting edge 8*a* with respect to the design surface. More specifically, distance calculating unit 205 calculates cutting edge 8*a* being located above or below the design surface as well as a distance between the design surface and cutting edge 8*a* in the direction vertical to the design surface.

Design surface angle calculating unit 206 acquires the data of the design surface from design surface information acquiring unit 202, and calculates an inclination angle of the design surface with respect to the horizontal direction.

Computing unit 210 acquires the revolving operation signal, the boom operation signal, the arm operation signal, and the bucket operation signal from operating device 40, and outputs a control signal to a proportional solenoid valve 63 based on the information, thereby performing the operation for revolving the revolving unit and driving of work implement 5.

Proportional solenoid valve 63 is provided in a pilot circuit that connects first control lever device 41 and second control lever device 42 to a pilot switching valve for controlling supply and discharge of the hydraulic oil to and from each of boom cylinder 9, arm cylinder 10 and bucket cylinder 11. Proportional solenoid valve 63 adjusts an opening degree thereof in accordance with the control signal from controller 20. A pilot pressure corresponding to the opening degree of proportional solenoid valve 63 is applied to a pilot port of each pilot switching valve, and thereby, boom 6, arm 7 and bucket 8 are driven.

Computing unit 210 has a plurality of functional blocks representing control functions implemented by computation. Computing unit 210 has an operation restricting unit 211 and a restriction lifting unit 212.

Based on the data of the design surface acquired from design surface information acquiring unit 202 and the current position of cutting edge 8*a* acquired from cutting edge position computing unit 204, computing unit 210 computes the current positional relationship between cutting edge 8*a* and the design surface. When the operation of hydraulic excavator 1 satisfies a prescribed condition, operation restricting unit 211 instructs execution of operation restriction control.

Specifically, operation restricting unit 211 executes the operation restriction control for forcibly stopping work implement 5 when it is expected that cutting edge 8*a* of bucket 8 will invade the design surface. As a result, automatic control (stop control) for preventing invasion of the design surface by cutting edge 8*a* of bucket 8 is executed.

When the operation of hydraulic excavator 1 satisfies a prescribed condition, restriction lifting unit 212 instructs operation restricting unit 211 to cancel the stop control as the operation restriction control. Specifically, when cutting edge 8*a* moves away from the design surface in the downward perpendicular direction by a prescribed distance or longer even in the state where cutting edge 8*a* is located at a position equal to or lower than the design surface in the perpendicular direction, the operation restriction control is canceled. As a result, in the case where cutting edge 8*a* is located away from the design surface in the downward perpendicular direction by the prescribed distance or longer, operation restricting unit 211 does not instruct execution of the operation restriction control.

When operation restricting unit 211 does not instruct execution of the operation restriction control, computing unit 210 provides the output to proportional solenoid valve 63 without correcting the output to proportional solenoid valve 63. As a result, in accordance with the operator's operation of operating device 40, work implement 5 operates as intended by the operator.

FIG. 5 representatively shows only the functional blocks corresponding to a part of functions related to control of hydraulic excavator 1 according to the present embodiment, of the control functions implemented by control of hydraulic excavator 1 using control system 200. Each functional block shown in the figure may function as software implemented by controller 20 executing a program, while each functional block may be implemented by hardware. Such a program may be recorded on a storage medium and mounted on hydraulic excavator 1, and may be inputted to hydraulic excavator 1 via communication terminal 91.

Figure 6:
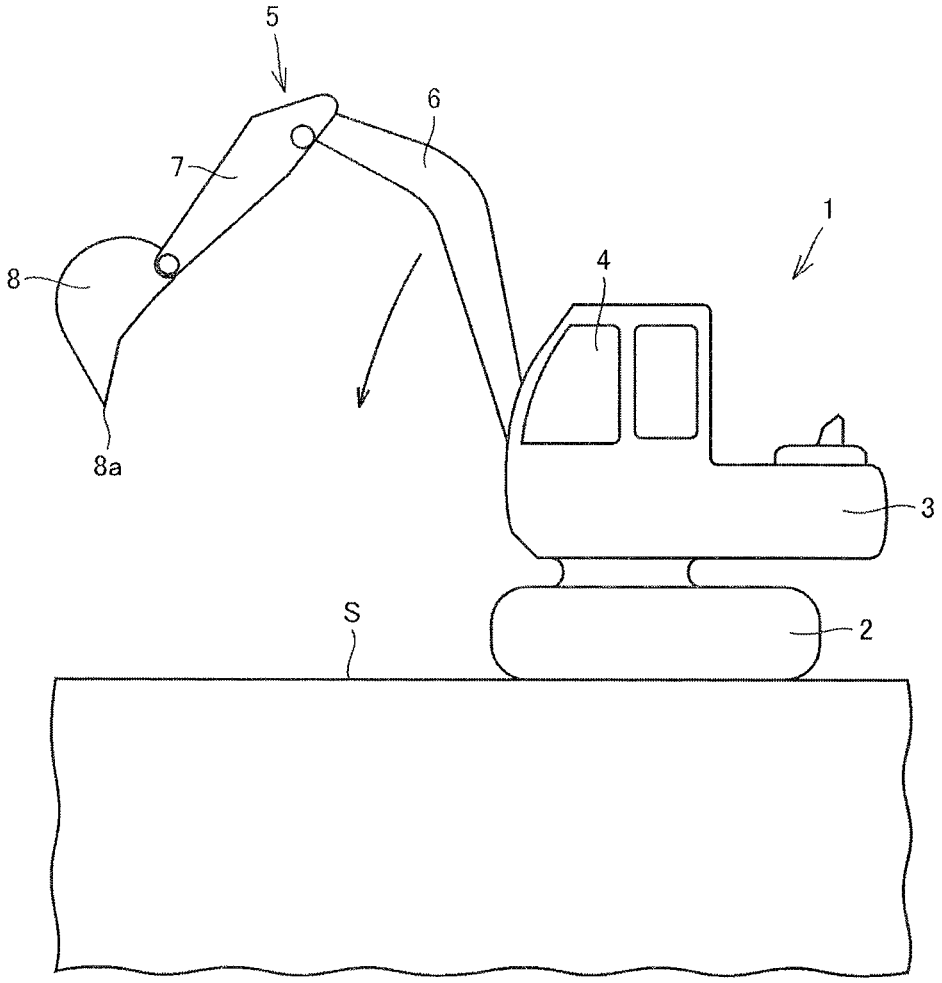
FIG. 6 is a schematic view before a work implement is aligned in a land leveling work with the hydraulic excavator.
Figure 7:
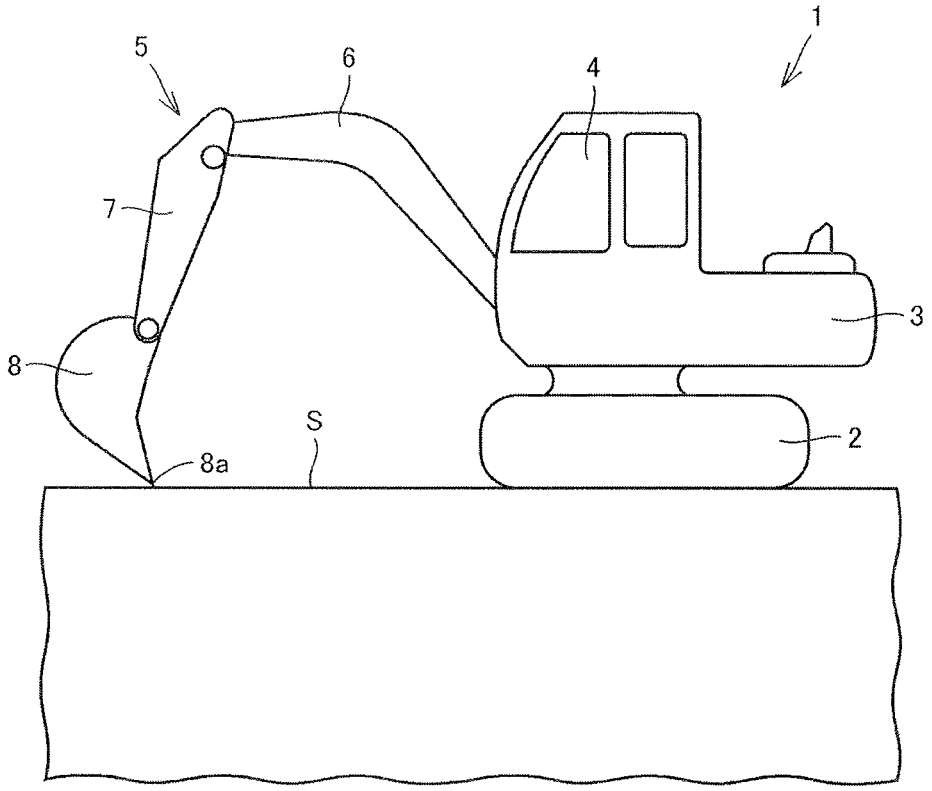
FIG. 7 is a schematic view after the work implement is aligned in the land leveling work with the hydraulic excavator.

The land leveling work with hydraulic excavator 1 having the aforementioned configuration will be described below. FIG. 6 is a schematic view before work implement 5 is aligned in the land leveling work with hydraulic excavator 1. FIG. 7 is a schematic view after work implement 5 is aligned in the land leveling work with hydraulic excavator 1. A design surface S shown in FIGS. 6 and 7 represents a target shape of a work object by work implement 5 in accordance with the construction design data prestored in storage unit 201 of controller 20 (FIG. 5). Controller 20 executes the aforementioned stop control based on the construction design data and the current positional information of work implement 5.

When cutting edge 8*a* of bucket 8 is aligned with design surface S from the state in which work implement 5 is located above design surface S as shown in FIG. 6, the operator operating work implement 5 performs the operation for lowering boom 6. In accordance with this operator's operation, boom 6 is lowered and cutting edge 8*a* of bucket 8 comes closer to design surface S as shown by an arrow in FIG. 6.

In hydraulic excavator 1, in order to avoid cutting edge 8*a* of bucket 8 from moving to be lower than design surface S and cutting into design surface S, control for automatically stopping the operation of work implement 5 at a position where cutting edge 8*a* comes into contact with design surface S is executed. When it is expected that cutting edge 8*a* of bucket 8 will move to be lower than design surface S, controller 20 executes control for automatically stopping boom 6 to prevent cutting edge 8*a* of bucket 8 from becoming lower than design surface S. As described above, cutting edge 8*a* of bucket 8 is aligned with design surface S as shown in FIG. 7.

Figure 8:
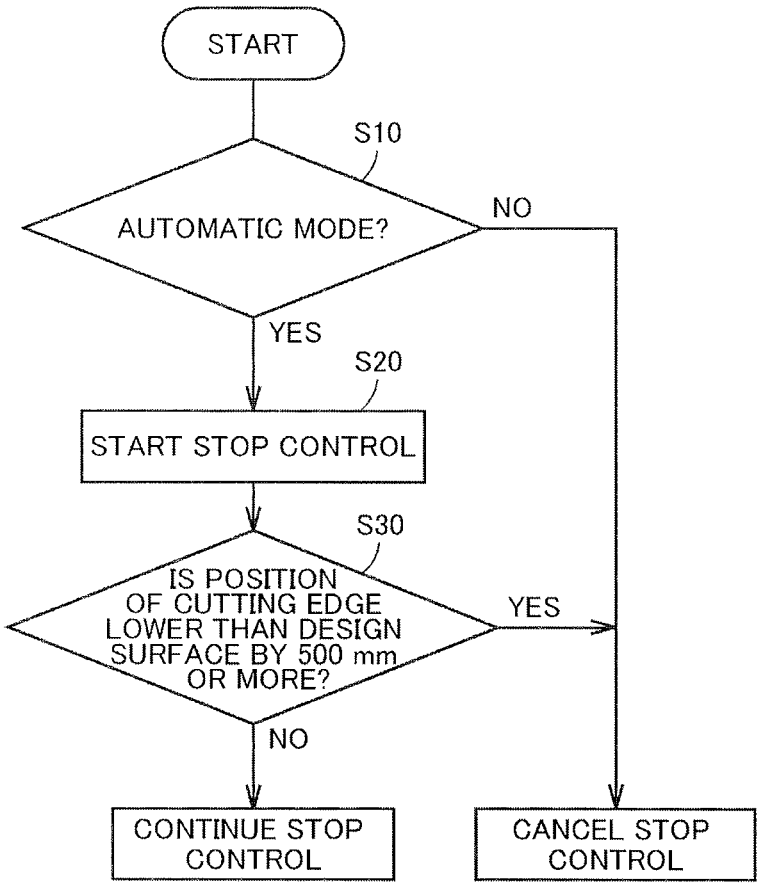
FIG. 8 is a flowchart for describing the operation of the control system of the hydraulic excavator.

FIG. 8 is a flowchart for describing the operation of control system 200 of hydraulic excavator 1. FIG. 8 shows the operation when control system 200 executes the stop control. First, in step S10, control system 200 determines whether an automatic mode, of the automatic mode and a manual mode, is selected or not. Switching between the automatic mode and the manual mode is done by the operator's operation. If the manual mode is selected (NO in step S10), work implement 5 is driven in the manual mode.

If the automatic mode is selected (YES in step S10), the process proceeds to step S20 and work, implement 5 is driven with the stop control being in execution. When it is expected that cutting edge 8*a* of bucket 8 will invade the design surface, operation restricting unit 211 shown in FIG. 5 executes the stop control to prevent the invasion of the design surface by cutting edge 8*a*.

Next, in step S30, control system 200 determines whether or not cutting edge 8*a* of bucket 8 is located lower than the design surface by a prescribed distance or longer. Computing unit 210 shown in FIG. 5 acquires the data of design surface S from design surface information acquiring unit 202, and also acquires the current position of cutting edge 8*a* from cutting edge position computing unit 204. Computing unit 210 compares design surface S with the current position of cutting edge 8*a*, and calculates the distance between design surface S and cutting edge 8*a*. Furthermore, computing unit 210 reads a threshold value of the distance between design surface S and cutting edge 8*a* from storage unit 201, and compares the distance between design surface S and cutting edge 8*a* with this threshold value, thereby determining whether or not cutting edge 8*a* is located away from design surface S by the prescribed distance or longer.

As shown in FIG. 8, the threshold value of the distance between design surface S and cutting edge 8*a* may be, for example, 500 mm. When the stop control is in execution normally, a movement range of cutting edge 8*a* should be restricted to an area located above design surface S. Therefore, when cutting edge 8*a* is located away from design surface S in the downward perpendicular direction by 500 mm, it is conceivable that the phenomenon such as disconnection or sensor abnormality is occurring. When cutting edge 8*a* is located away from design surface S by 500 mm, it is conceivable that the stop control is not effective, and thus, the stop control is canceled.

If it is determined in step S30 that the distance between design surface S and cutting edge 8*a* is shorter than 500 mm, the stop control is continued and work implement 5 is driven with the stop control being in execution. When cutting edge 8*a* comes closer to design surface S from the upward perpendicular direction, operation restricting unit 211 stops the operation of work implement 5 at the position where cutting edge 8*a* reaches design surface S.

If it is determined in step S30 that the distance between design surface S and cutting edge 8*a* is equal to or longer than 500 mm, the stop control is canceled. As a result, work implement 5 is driven in the manual mode. In this case, even in the state where cutting edge 8*a* of bucket 8 is located lower than design surface S in the perpendicular direction, the boom-lowering operation is not prohibited and the instruction signal for performing the operation for lowering boom 6 can be outputted.

Next, the function and effect of the present embodiment will be described.

As shown in FIG. 5, hydraulic excavator 1 according to the present embodiment includes design surface information acquiring unit 202 for acquiring the data of design surface S, cutting edge position computing unit 204 for computing the position of cutting edge 8*a* of bucket 8, and operation restricting unit 211 for executing the operation restriction control by which, when cutting edge 8*a* of bucket 8 comes closer to design surface S, the operation of work implement 5 is stopped before cutting edge 8*a* of bucket 8 reaches design surface S. As shown in FIG. 8, in the case where cutting edge 8*a* is located away from design surface S in the downward perpendicular direction by the prescribed distance or longer, operation restricting unit 211 does not execute the operation restriction control.

Figure 9:
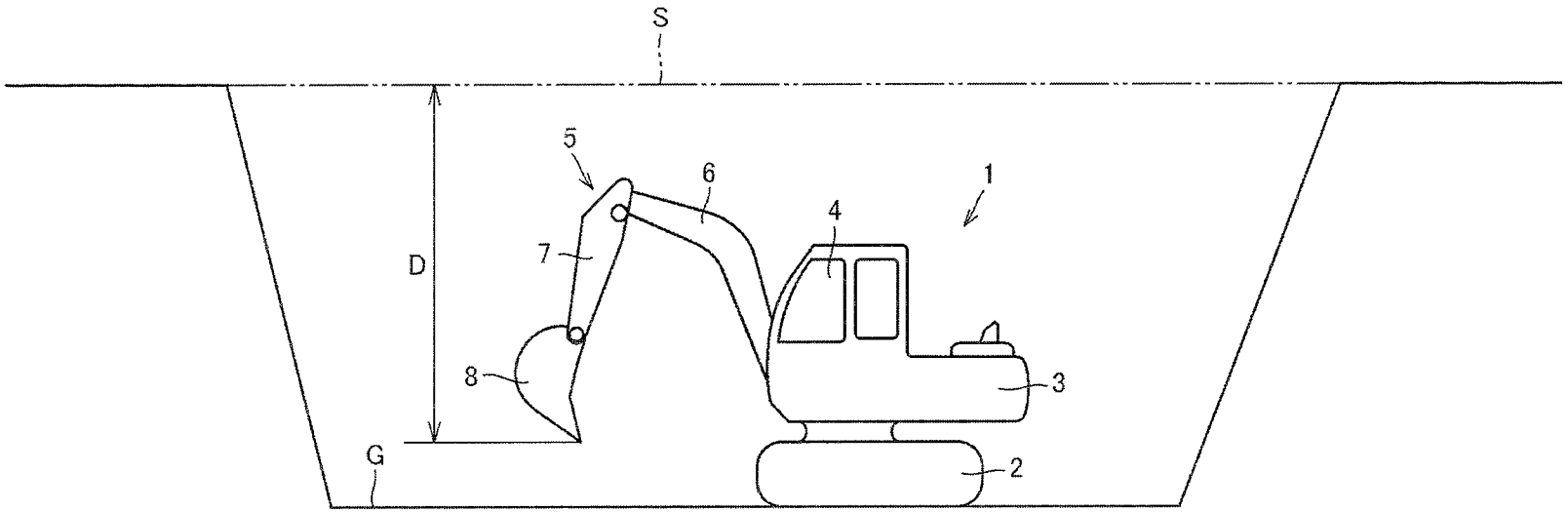
FIG. 9 is a schematic view showing one example of a positional relationship between a bucket and a design surface.

FIG. 9 is a schematic view showing one example of a positional relationship between bucket 8 and design surface S. A character "G" in FIG. 9 represents a ground of the current landform. A character "S" in FIG. 9 represents the aforementioned design surface. FIG. 9 shows the depression landform that will be subjected to the embankment work, and design surface S shown in FIG. 9 corresponds to an upper surface of an embankment. A character "D" in FIG. 9 represents a distance between design surface S and cutting edge 8*a* of bucket 8 in the perpendicular direction.

Hydraulic excavator 1 shown in FIG. 9 is arranged on a bottom surface of the depression and is located within an area lower than design surface S. If the operation restriction control for preventing invasion of design surface S by cutting edge 8*a* of bucket 8 is effective in such a state, hydraulic excavator 1 shown in FIG. 9 cannot operate work implement 5.

By executing control so as not to execute the operation restriction control when cutting edge 8*a* is located away from design surface S in the downward perpendicular direction by the prescribed distance or longer as in the present embodiment, the operator operating hydraulic excavator 1 can freely operate work implement 5. The operator's operation can be reflected in the operation of work implement 5 in the state where bucket 8 is located lower than design surface S and it is possible to eliminate the situation in which work implement 5 is inoperative in the area lower than design surface S. Therefore, it is possible to prevent the operator from erroneously recognizing the situation in which work implement 5 is inoperative as a failure of work implement 5.

Conventionally, the operator had to turn off the automatic control and switch the mode to the manual mode in order to freely operate work implement 5 in the state where bucket 8 is located lower than design surface S, and the switching operation was complicated. In hydraulic excavator 1 according to the present embodiment, without the need to turn off the automatic control, work implement 5 can be freely operated in the state where bucket 8 is located lower than design surface S. Therefore, switching to the manual mode is unnecessary and the complication can be overcome.

While the embodiment of the present invention has been described above, it should be understood that the embodiment disclosed herein is illustrative and not limitative in any respect. The scope of the present invention is defined by the terms of the claims, rather than the description above, and is intended to include any modifications within the scope and meaning equivalent to the terms of the claims.

REFERENCE SIGNS LIST

1 hydraulic excavator; 2 undercarriage; 3 upper revolving unit; 5 work implement; 6 boom; 7 arm; 8 bucket; 8*a* cutting edge; 9 boom cylinder; 10 arm cylinder; 11 bucket cylinder; 16 first stroke sensor; 17 second stroke sensor; 18 third stroke sensor; 20 controller; 40 operating device; 41 first control lever device; 41A boom operation detecting unit; 41B bucket operation detecting unit; 42 second control lever device; 42A revolving operation detecting unit; 42B arm operation detecting unit; 44 first control lever; 45 second control lever; 63 proportional solenoid valve; 90 input unit; 91 communication terminal; 200 control system; 201 storage unit; 202 design surface information acquiring unit; 203 work implement angle computing unit; 204 cutting edge position computing unit; 205 distance calculating unit; 206 design surface angle calculating unit; 210 computing unit; 211 operation restricting unit; 212 restriction lifting unit; S design surface.

The invention claimed is:

1. A work vehicle, comprising:

a work implement having a boom, an arm attached to a distal end of said boom, and a bucket attached to a distal end of said arm;

a design surface information acquiring unit for acquiring data of a design surface indicative of a target shape of a work object by said work implement;

a cutting edge position computing unit for computing a position of a cutting edge of said bucket; and an operation restricting unit for executing operation restriction control by which, when said cutting edge of said bucket comes closer to said design surface, operation of said work implement is stopped before said cutting edge of said bucket reaches said design surface, wherein in a case where said cutting edge is located away from said design surface in a downward perpendicular direction by a prescribed distance or longer, said operation restricting unit does not execute said operation restriction control.

2. The work vehicle according to claim 1, wherein said operation restricting unit controls said boom to prevent the position of said cutting edge from becoming lower than said design surface.

3. The work vehicle according to claim 2, wherein the work vehicle transmits and receives information to and from the outside by satellite communication.

4. The work vehicle according to claim 1, wherein the work vehicle transmits and receives information to and from the outside by satellite communication.

5. The work vehicle according to claim 1, wherein in a case where said cutting edge is located away from said design surface in a downward perpendicular direction by a prescribed distance or longer, with said operation restriction control being in execution, said operation restricting unit does not execute said operation restriction control.

* * * * *